United States Patent [19]

Suga et al.

[11] Patent Number: 4,996,130

[45] Date of Patent: Feb. 26, 1991

[54] SILVER HALIDE PHOTOGRAPHIC MATERIAL

[75] Inventors: Shuzo Suga; Masaki Satake; Senzo Sasaoka, all of Kanagawa, Japan

[73] Assignee: Fuji Photo Film Co., Ltd., Kanagawa, Japan

[21] Appl. No.: 492,212

[22] Filed: Mar. 13, 1990

Related U.S. Application Data

[63] Continuation of Ser. No. 284,010, Dec. 13, 1988, abandoned.

[30] Foreign Application Priority Data

Dec. 15, 1987 [JP] Japan ..... 63-316972

[51] Int. Cl.[5] ..... G03C 1/08; G03C 1/04

[52] U.S. Cl. ..... 430/264; 430/536; 430/537; 430/627; 430/628

[58] Field of Search ..... 430/264, 536, 537, 598, 430/627, 628

[56] References Cited

U.S. PATENT DOCUMENTS 4,323,643 4/1982 Mifune et al. ..... 430/441
4,777,113 10/1988 Inoue et al. ..... 430/264

FOREIGN PATENT DOCUMENTS 0143436 4/1983 European Pat. Off. ..... 430/536

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A negative type silver halide photographic material is disclosed, which comprises a support having thereon at least one silver halide emulsion layer and at least one other hydrophilic colloidal layer, wherein at least one said silver halide emulsion layer or at least one said other hydrophilic colloidal layer contains a hydrazine derivative and a polyacrylamide derivative.

4 Claims, No Drawings

SILVER HALIDE PHOTOGRAPHIC MATERIAL

This is a Continuation of Application No. 07/284,010 filed Dec. 13, 1988 now abandoned.

FIELD OF THE INVENTION

The present invention relates to a silver halide photographic material and, more particularly, to a silver halide photographic material to be used in the photoengraving field which can form a superhigh contrast image with high resolving power.

BACKGROUND OF THE INVENTION

It has been known to form extremely contrasty photographic images by combining a hydrazine derivative and certain kinds of silver halide emulsions, and such image-forming processes have been employed in the photoengraving field.

For example, it has been known to obtain superhigh contrast negative images by processing a surface latent image-forming silver halide photographic material containing a hydrazine derivative (for example, a specific acylhydrazine compound as described in U.S. Pat. Nos. 4,166,742, 4,168,977, 4,211,857, 4,224,401, 4,243,739, 4,272,606 and 4,311,781) with a solution having a pH of 11.0 to 12.3 and containing a sulfite preservative in a concentration of 0.15 mol/liter or more.

This process enables one to obtain a superhigh contrast tone (as high as more than 10 in gamma value). However, since it utilizes an infectious development mechanism due to the hydrazine derivatives, the characteristics of the silver halide emulsion grains are also amplified as a result of the development.

In particular, it is well known that not only light-sensitive materials containing hydrazine derivatives but also other light-sensitive materials generally undergo generation of photoelectrons or lattice defects when pressure is applied to silver halide emulsion grains upon the materials being bent or scratched, and that they suffer sensitization, desensitization or fogging in the pressure-applied areas. Thus, various techniques have been employed for improving pressure resistance.

For example, it has been known to prevent pressure from reaching the particles by incorporating a plasticizer such as a polymer or an emulsion, or by decreasing the ratio of silver halide/gelatin in the silver halide emulsion.

As illustrative, British Pat. No. 738,618 discloses using heterocyclic compounds, British Pat. No. 738,637 discloses using alkyl phthalates, British Pat. No. 738,639 discloses using alkyl esters, U.S. Pat. No. 2,960,404 discloses using polyhydric alcohols, U.S. Pat. No. 3,121,060 discloses using carboxyalkyl cellulose, JP-A-49-5017 (the term "JP-A" as used herein refers to a "published unexamined Japanese patent application") discloses using a paraffin and a carboxylate, and JP-B-53-28086 (the term "JP-B" as used herein refers to an "examined Japanese patent publication") discloses using an alkyl acrylate and an organic acid.

As a technique for improving pressure properties of superhigh contrast light-sensitive materials containing a hydrazine derivative, JP-A-62-21143 discloses adding polyhydroxy-substituted benzenes. However, this technique is not fully satisfactory comparing its advantages with disadvantages (deterioration of adhesion resistance).

On the other hand, a novel image-forming system using a hydrazine derivative has the defect that, where the number of processed films is small, black peppers are seriously formed when the concentration of sulfite incorporated in the developer as a preservative is reduced due to fatigue of the developer with time or when the pH is increased. As technique for solving this problem, there is a technique of increasing the amount of a replenishing developer. However, this technique involves a problem of an increase in developer cost and a problem with waste liquor. Thus, it has been desired to develop a system or a film which does not suffer the formation of black peppers even when the amount of replenishing developer is not increased.

SUMMARY OF THE INVENTION

It is, therefore, an object of the present invention to provide a silver halide photographic material which contains a hydrazine derivative in combination with a silver halide emulsion, and which forms a superhigh contrast image (gradation ($\gamma$): 8 or more) with high resolving power.

Another object of the present invention is to provide a silver halide photographic material which has such excellent pressure resistance that it does not undergo fogging, sensitization or desensitization upon being bent or scratched.

A further object of the present invention is to provide a silver halide photographic material which shows less formation of black peppers, particularly when processed in a highly active developer (i.e., a developer having a reduced concentration of sulfite ions and an increased pH value) or under highly active conditions (i.e., a condition having an increased developing temperature and an increased developing time).

These and other objects of the present invention will become apparent from the following disclosure.

The above-described and other objects of the present invention are attained by a negative-type silver halide photographic material which comprises a support having thereon at least one silver halide emulsion layer and at least one other photographic colloidal layer, wherein at least one said silver halide emulsion layer, or at least one said other hydrophilic layer contains a hydrazine derivative and a polyacrylamide derivative, and by a process of forming a superhigh contrast negative image which comprises imagewise exposing the photographic material and development processing it in a developer preferably containing sulfite ion in a concentration of 0.15 mol/liter or more (particularly from 0.15 to 1.5 mol/liter) and preferably having a pH of 10.0 to 12.5.

DETAILED DESCRIPTION OF THE INVENTIOn

As the hydrazine derivatives to be used in the present invention, those hydrazine derivatives which are represented by the following formula (I) are preferable:

$$R_1\text{-NHNH-G-}R_2 \qquad \text{(I)}$$

wherein $R_1$ represents an aliphatic group or an aromatic group, $R_2$ represents a hydrogen atom, a substituted or unsubstituted alkyl group, a substituted or unsubstituted aryl group, a substituted or unsubstituted alkoxy group, or a substituted or unsubstituted aryloxy group, and G represents a carbonyl group, a sulfonyl group, a sulfoxy group, a phosphoryl group or an N-substituted or unsubstituted imino group.

In formula (I), the aliphatic group represented by $R_1$ preferably contains 1 to 30 carbon atoms, and is particularly preferably a straight, branched or cyclic alkyl group containing 1 to 20 carbon atoms. The branched alkyl group may be cyclized to form a saturated hetero ring containing one or more hetero atoms. This alkyl group may optionally have a substituent or substituents such as an aryl group, an alkoxy group, a sulfoxy group, a sulfonamido group or a carbonamido group.

In formula (I), the aryl group represented by $R_1$ is a monocyclic or bicyclic aryl group or an unsaturated heterocyclic group. The unsaturated heterocyclic group may be fused with a monocyclic or bicyclic aryl group to form a heteroaryl group.

For example, there are illustrated a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring, with those which contain a benzene ring being preferable.

An aryl group is particularly preferable as $R_1$.

The aryl group or unsaturated heterocyclic group represented by $R_1$ may be substituted. Typical substituents include a straight, branched or cyclic alkyl group (preferably containing 1 to 20 carbon atoms), an aralkyl group (a monocyclic or bicyclic one containing preferably 1 to 3 carbon atoms in the alkyl moiety), an alkoxy group (containing preferably 1 to 20 carbon atoms), a substituted amino group (substituted by an alkyl group containing preferably 1 to 20 carbon atoms), an acylamino group (containing preferably 2 to 30 carbon atoms), a sulfonamido group (containing preferably 1 to 30 carbon atoms), a ureido group (containing preferably 1 to 30 carbon atoms), etc.

In formula (I), the alkyl group represented by $R_2$ is preferably an alkyl group containing 1 to 4 carbon atoms and may be substituted by a halogen atom, a cyano group, a carboxyl group, a sulfo group, an alkoxy group, a phenyl group, or the like.

Of those groups represented by $R_2$ in formula (I), the optionally substituted aryl group is a monocyclic or bicyclic aryl group containing, for example, a benzene ring. This aryl group may be substituted by, for example, a halogen atom, an alkyl group, a cyano group, a carboxyl group or a sulfo group.

Of those groups represented by $R_2$ in formula (I), the optionally substituted alkoxy group is an alkoxy group containing 1 to 8 carbon atoms and being optionally substituted by, for example, a halogen atom or an aryl group.

Of those groups represented by $R_2$ in formula (I), the optionally substituted aryloxy group is preferably a monocyclic group, and substituents therefor include, for example, a halogen atom.

When G represents a carbonyl group, $R_2$ preferably represents a hydrogen atom, a methyl group, a methoxy group, an ethoxy group and a substituted or unsubstituted phenyl group, with a hydrogen atom being particularly preferable.

When G represents a sulfonyl group, $R_2$ preferably represents a methyl group, an ethyl group, a phenyl group, or a 4-methylphenyl group, with a methyl group being particularly preferable.

When G represents a phosphoryl group, $R_2$ preferably represents a methoxy group, an ethoxy group, a butoxy group, a phenoxy group or a phenyl group, with a phenoxy group being particularly preferable.

When G represents a sulfoxy group, $R_2$ preferably represents, for example, a cyano group or a methylthiobenzyl group and, when G represents an Nsubstituted or unsubstituted imino group, $R_2$ preferably represents a methyl group, an ethyl group or a substituted or unsubstituted phenyl group.

$R_1$ or $R_2$ in formula (I) may have a ballast group which is conventionally used in immobile photographic additives such as couplers. The ballast group is a comparatively inert group with respect to photographic properties and contains 8 or more carbon atoms and may be selected from, for example, an alkyl group, an alkoxy group, a phenyl group, an alkylphenyl group, a phenoxy group, and an alkylphenoxy group.

$R_1$ or $R_2$ in formula (I) may have a group that can strengthen adsorption onto the surface of silver halide grains. As such adsorptive group, there are illustrated, for example, a thiourea group, a heterocyclic thioamido group, a mercapto heterocyclic group and a triazole group as described in U.S. Pat. No. 4,385,108.

As G in formula (I), a carbonyl group is most preferable.

Specific examples of the compounds represented by formula (I) are illustrated below which, however, do not limit the present invention in any way.

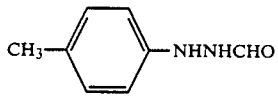

I-1

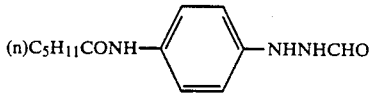

I-2

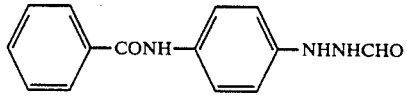

I-3

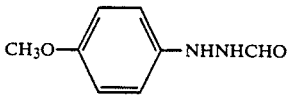

I-4

-continued
I-5
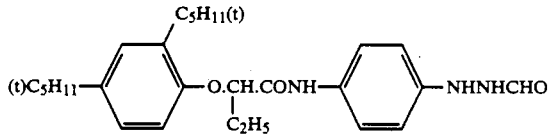
I-6
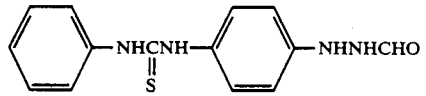
I-7
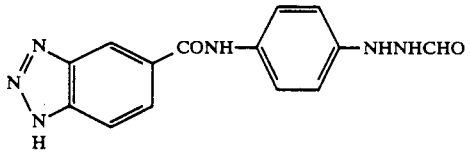
I-8
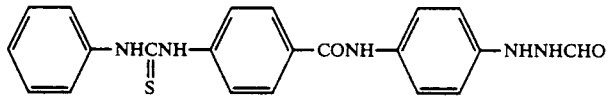
I-9
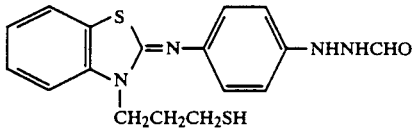
I-10
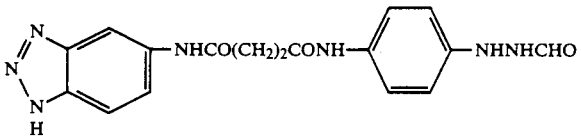
I-11
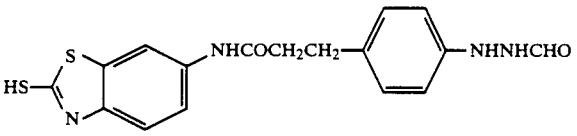
I-12
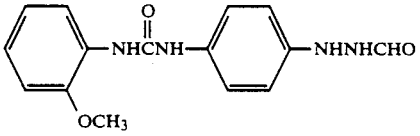
I-13
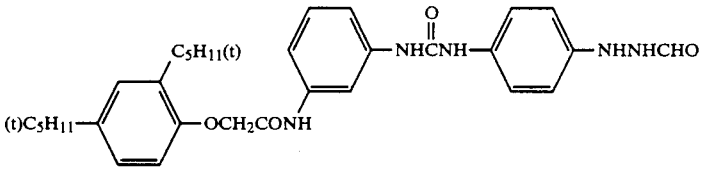
I-14
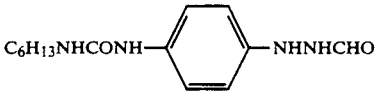

-continued
I-15
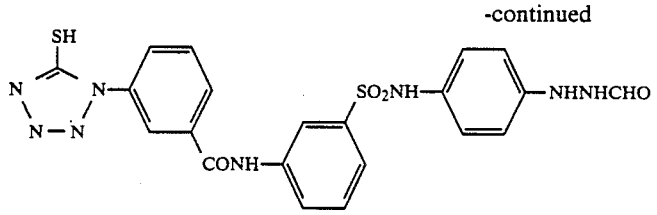
I-16
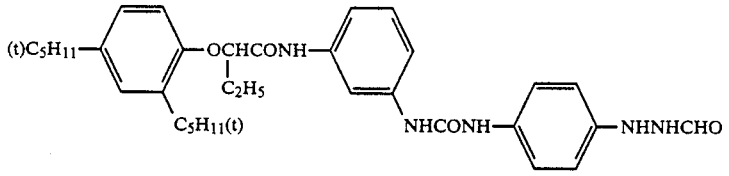
I-17
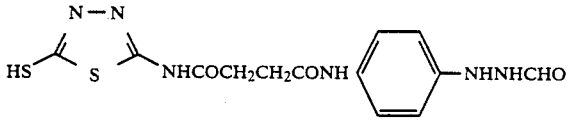
I-18
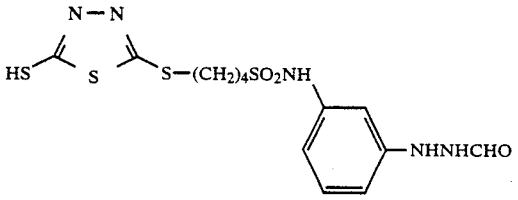
I-19
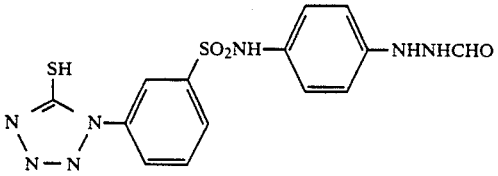
I-20
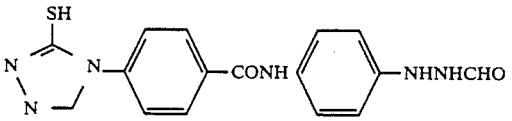
I-21
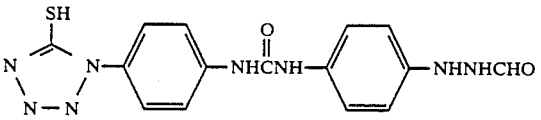
I-22
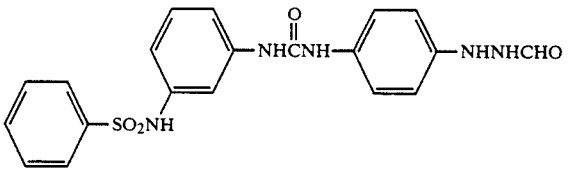
I-23
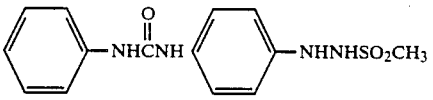
I-24
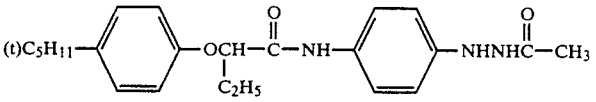

-continued

I-25

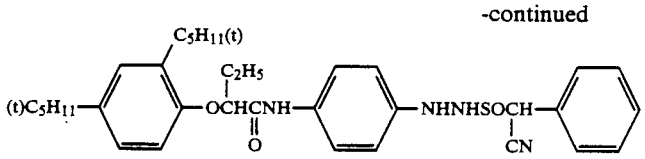

I-26

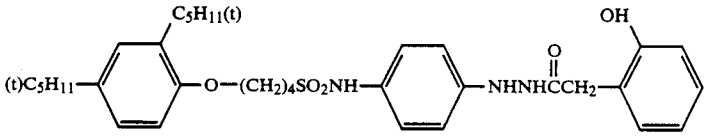

I-27

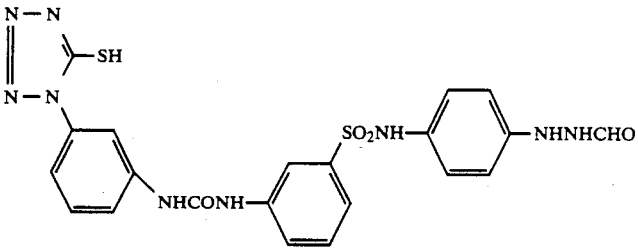

I-28

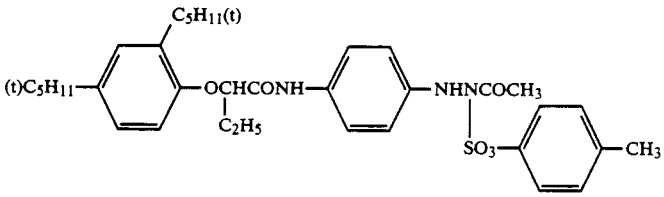

I-29

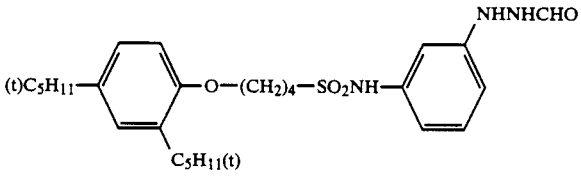

I-30

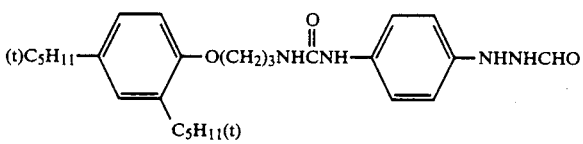

I-31

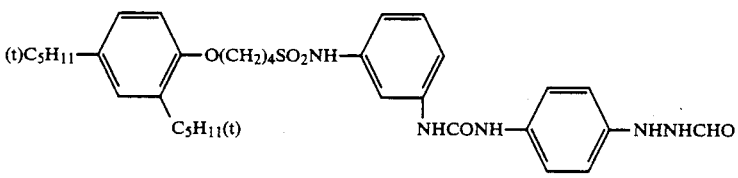

As the hydrazine derivatives used in the present invention, those which are described in *Research Disclosure*, Item 23516 (November, 1983), p. 346, and the literature cited therein, U.S. Pat. Nos. 4,080,207, 4,269,929, 4,276,364, 4,278,748, 4,385,108, 4,459,347, 4,560,638, 4,478,928 and 4,560,638, British Pat. No. 2,011,391, and JP-A-60-179734 may be used in addition to those which are described above.

Furthermore, nucleating agents as described in Japanese Patent Application Nos. 62-67508, 62-67509, and 2-67510 may be used.

The polyacrylamide derivatives of the present invention are described in detail below. The polyacrylamide derivatives used in the present invention are polymers of ethylenically unsaturated monomers containing the repeating units represented by formula (II):

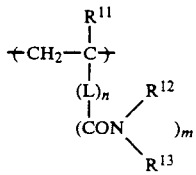

(II)

In the above formula (II), $R^{11}$ represents a hydrogen atom or an alkyl group containing 1 to 6 carbon atoms, $R^{12}$ and $R^{13}$, which may be the same or different, each represents a hydrogen atom, a substituted or unsubstituted alkyl group containing not more than 10 carbon atoms, an aryl group or an aralkyl group, or $R^{12}$ and $R^{13}$ may be bound to each other to form a nitrogencontaining hetero ring together with a nitrogen atom.

L represents a divalent linking group, n represents 0 or 1, and m represents 1 or 2. Preferable polymers of the present invention containing the repeating units represented by formula (II) are described below.

In formula (II), $R^{11}$ represents a hydrogen atom or an alkyl group containing 1 to 6 carbon atoms, and preferably a hydrogen atom or a methyl group.

$R^{12}$ and $R^{13}$, which may be the same or different, each represents a hydrogen atom, a substituted or unsubstituted alkyl group, aryl group or aralkyl group, containing not more than 10 carbon atoms. As the substituents, there are illustrated, for example, a hydroxy group, a lower alkoxy group, a halogen atom, an amido group, a cyano group, a sulfonic acid group and a carboxylic acid group. $R^{12}$ and $R^{13}$ each preferably represents a hydrogen atom, a methyl group, an ethyl group or a phenyl group, most preferably a hydrogen atom.

L represents a divalent linking group, and is exemplified by an alkylene group containing 1 to 10 carbon atoms, an arylene group containing 1 to 10 carbon atoms, and a divalent linking group obtained by combining these groups and linking bonds such as an ether bond, an ester bond and an amido bond.

n represents 0 or 1, preferably 0.

m represents 1 or 2, preferably 1.

Of the ethylenically unsaturated monomers constituting the repeating units represented by formula (II), preferably specific examples of the monomers are those illustrated below.

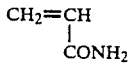
II-1

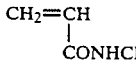
II-2

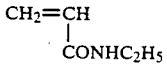
II-3

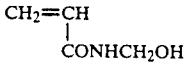
II-4

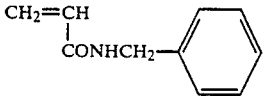
II-5

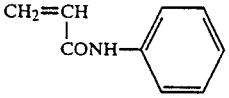
II-6

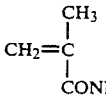
II-7

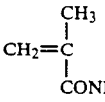
II-8

-continued

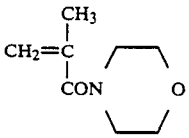
II-9

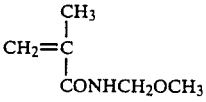
II-10

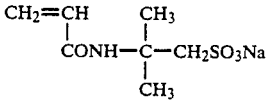
II-11

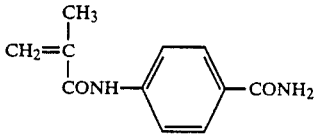
II-12

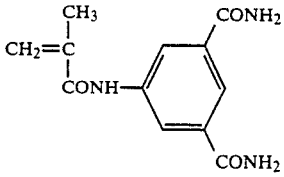
II-13

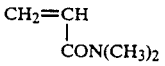
II-14

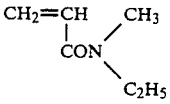
II-15

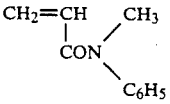
II-16

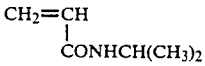
II-17

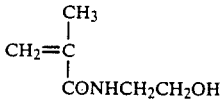
II-18

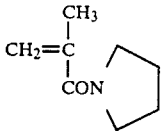
II-19

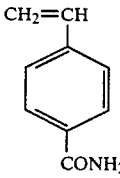
II-20

The repeating units represented by formula (II) may contain two or more kinds of monomer units for the purpose of giving composite functions (i.e., improvement of scratch resistance, reduced formation of black peppers and improvement of adhesiveness) to the resulting polymer.

The high molecular weight polymer (polyacrylamide derivative) used in the present invention is a compound which contains preferably 70 mol% or more, more preferably 80 mol% or more, most preferably 90 mol% or more, of the monomer represented by formula (II) as polymer-constituting units, and is represented by the following formula (III), where terms are as defined for formula (II),

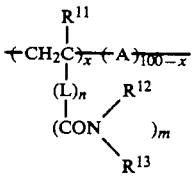

(III)

wherein x represents mol percentage (mol%) and is generally 10 to 100, preferably 70 to 100, particularly preferably 95 to 100.

In formula (III), A represents a monomer unit which is a copolymerizable ethylenically unsaturated monomer.

Examples of A include monomer units of compounds as shown below.

(a) Ethylenically unsaturated monocarboxylic or dicarboxylic acids and their salts. For example,

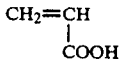

a-1

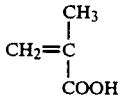

a-2

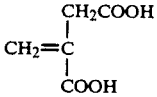

a-3

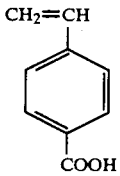

a-4

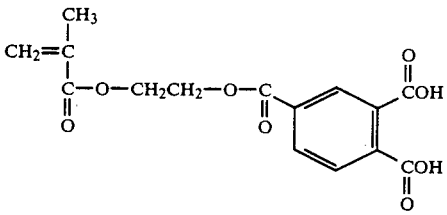

a-5

Alkali metal salts (for example, sodium and potassium salts), alkaline earth metal salts (for example, cadmium and magnesium salts), and ammonium salts thereof are preferred.

(b) Maleic anhydride, maleic acid and alkali metal salts (e.g., sodium salt, potassium salt), alkaline earth metal salts (e.g., cadmium salt, magnesium salt) and ammonium salt thereof.

(c) Vinylbenzenesulfonic acid, vinylbenzylsulfonic acid, acrylamido-2-methylpropanesulfonic acid, and alkali metal salts (e.g., sodium salt, potassium salt), alkaline earth metal salts (e.g., cadmium salt, magnesium salt) and ammonium salt thereof are also preferably used as A. Further, (d) Gelatin reactive monomers disclosed in, for example, JP-A-56-151937, JP-A-57-104927 and JP-A-56-142524 such as

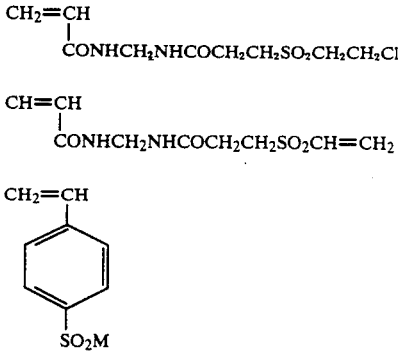

M = Na or K may be copolymerized for improving film properties (for example, improvement of adhesiveness and improvement of scratch resistance).

The crosslinked polymers (i.e., polyacrylamide derivatives) of the present invention may contain monomer units used for copolymerizing other copolymerizable ethylenically unsaturated monomer units in order to obtain the composite functions. Examples of such the copolymerizable ethylenically unsaturated monomers include ethylene, propylene, 1-butene, isobutene, styrene, chloromethylstyrene, hydroxymethylstyrene, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzylvinylpyridinium chloride, N-vinylacetamide, N-vinylpyrrolidone, 1-vinyl-2-methylimidazole, monoethylenically unsaturated esters of aliphatic acids (for example, vinyl acetate and allyl acetate), esters of ethylenically unsaturated monocarboxylic or dicarboxylic acids (for example, n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluenesulfonate, N,N-diethyl-N-methyl-N-methacryloyloxyethylammonium-p-toluenesulfonate, dimethyl itaconate, and monobenzyl maleate), etc. In addition, the polymers of the present invention may contain two or more kinds of monomer units for obtaining the composite functions.

Preferable examples of the polymers used in the present invention are illustrated below. (The polymerization degrees are represented in terms of mol%.)

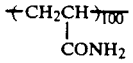

(P-1)

-continued

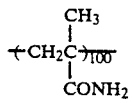
(P-2)

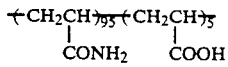
(P-3)

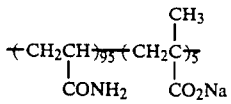
(P-4)

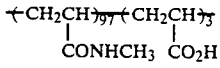
(P-5)

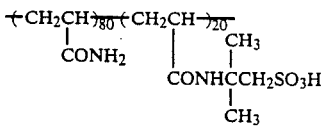
(P-6)

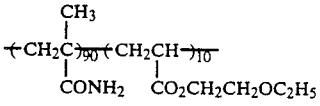
(P-7)

(P-8)

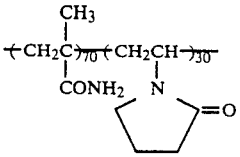
(P-9)

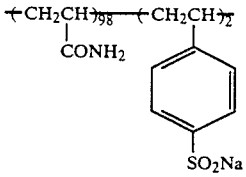
(P-10)

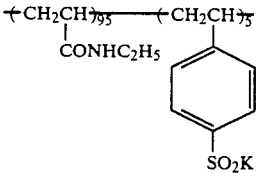
(P-11)

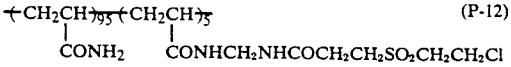
(P-12)

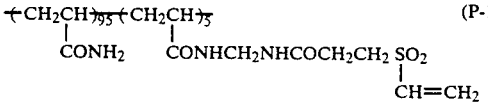
(P-13)

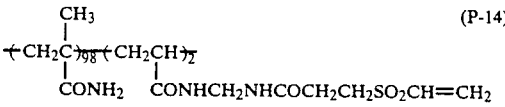
(P-14)

-continued

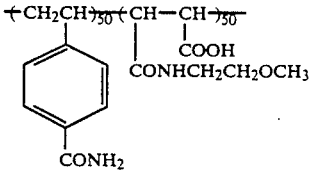
(P-15)

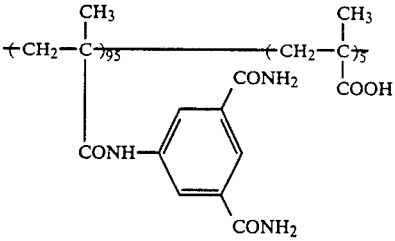
(P-16)

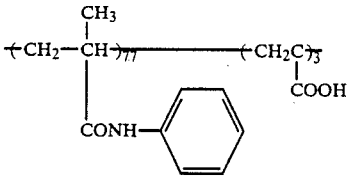
(P-17)

As polymers having the repeating units represented by formula (II) added to a photographic emulsion layer in the present invention, those which have a weight average molecular weight ($\overline{M}w$) of generally 2,000 to 200,000, preferably 2,000 to 50,000, and more preferably 2,000 to 10,000, are preferred in view of the prevention of black peppers, scratching resistance, and adhesion.

SYNTHESIS EXAMPLE

Synthesis of Illustrative Compound P-1:

6.25 g (0.088 mol) of acrylamide, 160 ml of methanol and 20 ml of isopropyl alcohol were charged in a 1 liter 3-neck flask equipped with a dropping device (HEIDON ROBO PUMP, made by Shinto Scientific Co., Ltd.), a stirring device, a refluxing condenser, a nitrogen introduction pipe, and a measuring pipe, and stirred. The mixture was heated over an oil bath (outer temperature being set to 60° C.) and, after the inner temperature stably showing 55° C., a solution of 3.24 g (0.014 mol) of V-601 (dimethyl 2,2'-azobisisobutyrate) in 20 ml of methanol was added thereto as a polymerization initiator. Stirring was continued for 10 minutes. About 1 minute after the addition of V-601, the solution became turbid due to precipitation of formed polymer.

93.5 g (1.32 mol) of acrylamide was dissolved in 180 ml of methanol and 20 ml of isopropyl alcohol, and the resulting solution was dropwise added thereto at a rate of 1.6 ml/min using the dropping device. The inner temperature rose due to the polymerization heat and became constant at 60° C. After completion of the dropwise addition, stirring was continued for one further hour to conduct post polymerization.

Then, heating was stopped, and the inner temperature was cooled to room temperature to discontinue the reaction. The contents were filtered through a Nutsche, and the white precipitate was washed with 200 ml of methanol. The product was dried overnight in a drying box at 40° C.

Yield: 450 g.

Loss in weight on drying: 90.8 (wt%)

Solution viscosity: 73.6 (cp)

Reduced specific viscosity: 0.31 (−)
Molecular weight ($\overline{M}w$): 42,000
Turbidity: 0.14 (ppm)

Conditions for Measuring Physical Properties:

(1) Polymer Content

About 2 g of a sample was accurately weighed in an aluminum boat-shaped dish (10 cm × 10 cm, about 4 g), and was heated in a vacuum dryer to 120° C. using a heater with reduced pressure by means of a vacuum pump (for about 3 hours). The residue was quickly weighed before the residue absorbed moisture, and the polymer content was calculated according to the following formula:

$$\text{Content (wt \%)} = \frac{\text{Weight of Residue (g)}}{\text{Weight of Sample (g)}} \times 100$$

(2) Solution Viscosity

A 20% aqueous solution of a sample was prepared, and its solution viscosity at 25° C. was measured using a model E viscometer ("model EMD", made by Tokyo Precision Instrument Co., Ltd.).

(3) Reduced Specific Viscosity, nsp/C

A 1% aqueous solution of a polyacrylamide was prepared, and its specific viscosity was measured using a viscometer. Reduced specific viscosity was calculated based on the measured viscosity at 30° C.

(4) Weight Average Molecular Weight, $\overline{M}w$

A polyacrylamide was added to a 0.1 N NaCl aqueous solution to obtain a 0.2 wt% solution of polyacrylamide. This solution was used as a sample for measurement, and $\overline{M}w$ was measured using a light scattering type photometer (Chromatics, low angle measuring, light scattering type photometer, KMX-6).

In the present invention, the hydrazine derivative is generally added in an amount of $1\times10^{-6}$ to $5\times10^{-2}$ mol, particularly preferably $1\times10^{-5}$ to $2\times10^{-2}$ mol, per mol of silver halide.

The polyacrylamide derivative is added in an amount of 0.01 g to 5 g, particularly preferably 0.1 to 1.5 g, per $m^2$ of the photographic material.

The silver halide emulsions used in the present invention are not particularly limited as to halide composition, and any of those which form images with high contrast and high blackening density may be used. For example, silver chloride, silver bromide, silver chlorobromide, silver bromoiodide, silver chloroiodide, and silver chlorobromoiodide can be used.

Silver halide emulsions preferably used in the present invention are a silver bromoiodide emulsion, a silver chloroiodide emulsion and a silver chlorobromoiodide emulsion containing 0.05 mol% or more silver iodide (particularly preferably from 0.05 to 10 mol%).

The photographic emulsions used in the present invention can be prepared by processes as described in P. Glafkides, *Chimie et Physique Photographique*, Paul Montel Co., Paris (1967), G. F. Duffin, *Photographic Emulsion Chemistry*, The Focal Press, London (1966), and V. L. Zelikman et al., *Making and Coating Photographic Emulsion*, The Focal Press, London (1964), by a conversion process as described in, for example, U.S. Pat. Nos. 2,592,250 and 4,075,020, or by a core/shell emulsion preparing process as described in, for example, British Pat. No. 1,027,146.

As a manner of reacting a soluble silver salt (a silver nitrate aqueous solution) with a water-soluble halide salt, any of a single jet method, a double jet method, and combinations thereof may be employed. As one type of a double jet method, a process called a controlled double jet method where pAg in the liquid phase in which silver halide is formed is kept constant may be employed.

In addition, silver halide solvents such as ammonia, thioether and tetra-substituted thioureas may also be used upon formation of grains.

The controlled double jet method and the grain-forming method using a silver halide solvent easily provide silver halide emulsions containing grains with a regular crystal form and narrow grain size distribution.

The silver halide grains in the photographic emulsions of the present invention may have a comparatively wide grain size distribution. However, a narrow grain size distribution is preferred. It is particularly preferred that 90% by weight or number based on the total silver halide grains have a grain size in a range of ±40% of the average grain size (generally, such an emulsion is called a monodispersed emulsion).

The silver halide grains to be used in the present invention preferably are fine grains (of, for example, 0.7 μm or less), particularly grains of from 0.05 to 0.4 μm in grain size.

The silver halide grain in the photographic emulsions of the present invention may have a regular form such as a cubic form or an octahedral form. Further, they may have an irregular crystal form such as that of a sphere or a plate, etc., or they may have a combination of these crystal forms.

The silver halide grains may have a structure in which the inner part and the outer part are each composed of a different phase or may have a structure which is uniform throughout.

Two or more silver halide emulsions separately prepared may be mixed for use.

In forming silver halide grains or during physical ripening, cadmium salts, zinc salts, lead salts, thallium salts, iridium salts or complexes thereof, rhodium salts or complex salts thereof, or iron salts or complexes thereof, etc., may also be coexistent.

As a chemical sensitizing process, a gold sensitization is generally used, which may optionally be combined with, for example, a sulfur sensitization, a reduction sensitization, or another noble metal sensitization.

Among the noble metal sensitization, a gold sensitization is typical in which a gold compound, mainly a gold complex salt, is used. Noble metals other than gold, such as platinum, palladium, and iridium may also be incorporated. Specific examples are described in U.S. Pat. No. 2,448,060, British Pat. No. 618,061, etc.

Examples of sulfur sensitizing agents which can be used include not only sulfur compounds present in the gelatin per se but also various sulfur compounds such as thiosulfates, thioureas, thiazoles or rhodanines, etc. Specific examples are described in U.S. Pat. Nos. 1,574,944, 2,278,947, 2,410,689, 2,728,668, 3,501,313, and 3,656,955.

Examples of reduction sensitizing agents which can be used include stannous salts, amines, formamidine sulfinic acid and silane compounds, etc.

In addition, the silver halide emulsion may be optically sensitized for the purpose of increasing sensitivity and imparting light sensitivity for a desired region. In practicing optical sensitization, sensitizing dyes such as cyanine dyes and merocyanine dyes are used independently or in combination to conduct spectral sensitization or supersensitization.

These techniques are described in, for example, U.S. Pat. Nos. 2,688,545, 2,912,329, 3,397,060, 3,615,635 and 3,628,964, JP-B-43-4936, JP-B-44-14030, JP-A-55-52050, etc.

To the photographic emulsion used in the present invention there may be incorporated various compounds for the purpose of preventing the formation of fog or stabilizing photographic properties in the steps of producing, or during storage or processing of, the light-sensitive materials. That is, azoles (for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole); mercaptopyrimidines; mercaptotriazines; thioketo compounds such as oxazolinethione; azaindenes (for example, triazaindenes, tetraazaindenes (particularly 4-hydroxysubstituted (1,3,3a,7)tetraazaindenes), and pentaazaindenes); benzenethiosulfonic acid, benzenesulfinic acid, benzenesulfonic acid amide, etc., known as anti-foggants or stabilizers can be added.

Of these, benzotriazoles (for example, 5-methylbenzotriazole) and nitroindazoles (for example, 5-nitroindazole) are particularly preferable. These compounds may be incorporated in a processing solution.

The photographic light-sensitive material of the present invention may contain an organic or inorganic hardener in its photographic emulsion layers or other hydrophilic colloidal layers. For example, chromium salts (for example, chrome alum), aldehydes (for example, formaldehyde and glutaraldehyde), N-methylol compounds (for example, dimethylolurea), dioxane derivatives (for example, 2,3-dihydroxydioxane), active vinyl compounds (for example, 1,3,5-triacryloyl-hexahydro-s-triazine and 1,3-vinylsulfonyl-2-propanol), active halogen compounds (for example, 2,4-dichloro-6-hydroxy-s-triazine), mucohalogenic acids (for example, mucochloric acid), etc., may be used alone or in combination.

The light-sensitive material prepared according to the present invention may contain in its photographic emulsion layers or other hydrophilic colloidal layers various known surfactants for various purposes, for example, as coating aids, as antistatic agent, for improvement of slipping properties, as emulsification and dispersing aids, for prevention of adhesion and for improvement of photographic properties (for example, development acceleration, increase in contrast, and increase in sensitivity).

For example, nonionic surfactants such as saponin (steroids), alkylene oxide derivatives (for example, polyethylene glycol, polyethylene glycol/ polypropylene glycol condensates, polyethylene glycol alkyl ethers, polyethylene glycol alkyl aryl ethers, polyethylene glycol esters, polyethylene glycol sorbitan esters, polyalkylene glycol alkylamines or amides or silicone-polyethylene oxide adducts), glycidol derivatives (for example, alkenylsuccinic acid polyglycerides or alkylphenol polyglycerides), aliphatic esters of polyhydric alcohols, alkyl esters of sucrose; anionic surfactants containing an acidic group such as a carboxy group, a sulfo group, a phospho group, a sulfuric ester group or a phosphoric ester group, such as alkylcarboxylates (salts), alkylsulfonates (salts), alkylbenzenesulfonates (salts), alkylnaphthalenesulfonates (salts), alkylsulfates, alkyl phosphates, N-acyl-N-alkyltaurines, sulfosuccinates, sulfoalkyl polyoxyethylene alkyl phenyl ethers or polyoxyethylene alkyl phosphates; amphoteric surfactants such as amino acids, aminoalkylsulfonic acids, aminoalkylsulfuric esters, aminoalkyl phosphoric esters, alkyl betaines, amine oxides; and cationic surfactants such as alkylamine salts, aliphatic or aromatic quaternary ammonium salts, heterocyclic quaternary ammonium salts (for example, pyridinium and imidazolium salts) or phosphonium or sulfonium salts containing an aliphatic or heterocyclic ring can be used.

Surfactants particularly preferably used in the present invention are polyalkylene oxides of a molecular weight of 600 or more as described in JP-B-58-9412.

In the processing solution used in the present invention, dihydroxybenzene type developing agents are preferably used as developing agents, and p-aminophenol type developing agents or 3-pyrazolidone type developing agents are preferably used as auxiliary developing agents.

The dihydroxybenzene type developing agents used in the present invention include, for example, hydroquinone, chlorohydroquinone, bromohydroquinone, isopropylhydroquinone, methylhydroquinone, 2,3-dichlorohydroquinone, 2,3-dibromohydroquinone, 2,5-dimethylhydroquinone, etc., with hydroquinone being particularly preferable.

Examples of 1-phenyl-3-pyrazolidone or derivatives thereof used as auxiliary agents include 1-phenyl-3-pyrazolidone, 1-phenyl-4,4-dimethyl-3-pyrazolidone, 1-phenyl-4-methyl-4-hydroxymethy-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone and 1-p-tolyl-4,4-dimethyl-3-pyrazolidone.

Useful p-aminophenol type auxiliary developing agents include N-methyl-p-aminophenol, p-aminophenol, N-($\beta$-hydroxyethyl)-p-aminophenol, N-(4-hydroxyphenyl)glycine, 2-methyl-p-aminophenol, and p-benzylaminophenol, with N-methyl-p-aminophenol being particularly preferable.

The dihydroxybenzene type developing agents are preferably used in an amount of 0.05 mol/liter to 0.8 mol/liter. In the case of using a dihydroxybenzene compound and a 1-phenyl-3-pyrazolidone or p-aminophenol compound in combination, the former is preferably used in an amount of 0.05 mol/liter to 0.5 mol/liter, and the latter is preferably used in an amount of up to 0.06 mol/liter.

As sulfite preservatives used in the present invention, there are illustrated, for example, sodium sulfite, potassium sulfite, lithium sulfite, sodium bisulfite, potassium metabisulfite, formaldehyde-sodium bisulfite, etc. These sulfites are used in amounts of 0.3 mol/liter or more but, if used in excess, they form a precipitate in the developer to cause a stain of solution; thus the upper limit is preferably 1.2 mol/liter.

The developer of the present invention may contain, as a development accelerator, a tertiary amine compound, particularly those compounds described in U.S. Pat No. 4,269,929.

The developer of the present invention may further contain pH buffers such as boric acid, borax, sodium tertiary phosphate and potassium tertiary phosphate and the pH buffers described in JP-A-60-93433.

The developer may contain development inhibitors such as potassium bromide and potassium iodide; organic solvents such as ethylene glycol, diethylene glycol, triethylene glycol, dimethylformamide, methyl cellosolve, hexylene glycol, ethanol and methanol; and antifoggants or black pepper-preventing agents such as indazole compounds (for example, 5-nitroindazole), sodium 2-mercaptobenzimidazole-5-sulfonate and benzotriazole compounds (for example, 5-methylbenzotriazole). Particularly, when compounds such as 5-nitroindazole are used, they are generally dissolved previously in a separate portion from that which contains a dihydroxybenzene type developing agent and a sulfite preservative and are mixed, upon use, with the latter portion and diluted with water. In addition, the portion containing dissolved therein 5-nitroindazole is conveniently made alkaline to acquire a yellow color, which serves to facilitate its handling.

Further, toning agents, surfactants, hard water softeners, hardeners, etc., may be added. The developer preferably has a pH of 9 or more, more preferably 9.5 to 12.3.

As fixing agents, those with a commonly known composition may be used. As the fixing agents, organic sulfur compounds known to have the effect of fixing agents may be used as well as thiosulfates and thiocyanates. The fixing solution may contain a water-soluble aluminum salt such as aluminum sulfate or alum. The water-soluble aluminum salts are usually used in an amount of 0 to 3.0 g of aluminum/liter. Fe(III) ethylenediaminetetraacetate complex salts may be used as oxidizing agents.

Processing solution temperatures are usually selected between 18° C and 50° C., but temperatures lower than 18° C. or higher than 50° C. may be employed.

The processing of the present invention is preferably conducted using an automatic developing machine and, in this situation, sufficient superhigh contrast photographic properties can be obtained even when the total time from charging to discharging of light-sensitive materials through the steps of development, fixing, washing with water, and drying is shortened (i.e., 45 to 120 seconds).

The present invention is now illustrated in greater detail by reference to the following examples which, however, are not to be construed as limiting the present invention in any way.

EXAMPLE 1

(A) Preparation of Silver Halide Emulsion

A monodisperse silver chlorobromoiodide emulsion containing cubic grains of a 0.2 μm grain size (variation coefficient: 0.10; silver iodide content: 0.1 mol%; silver bromide content: 30 mol%) was prepared by a controlled double jet process. To the emulsion was added $(NH_4)_3RhCl_6$ in an amount of $1\times10^{-6}$ mol/mol-Ag. This emulsion was desalted in a conventional manner and subjected to gold and sulfur sensitization using sodium thiosulfate and potassium chloroaurate. This emulsion was referred to as Emulsion (a).

A monodisperse silver bromoiodide emulsion having 0.3 μm grain size (variation coefficient: 0.15; silver iodide content: 1 mol%; iodide distribution: rich at the surface) was prepared by a controlled double jet process. To the emulsion was added $K_3IrCl_6$ in an amount of $4\times10^{-7}$ mol/mol-Ag. This emulsion was referred to as Emulsion (b).

(B) Preparation of Coated Samples

To each of these emulsions were added $3\times10^{-4}$ mol/mol-Ag of 1-(2-hydroxyethoxyethyl)-3-(pyridin-2-yl)-5-[(3-sulfo butyl-5-chloro-pb 2-l -benzoxazolinylidene)ethylidene]-2-thiohydantoin potassium salt as a sensitizing dye and 1.5 g of 4-hydroxy-6-methyl-1,3,3a,7-tetraazaindene as a stabilizer, 2 g of chlorohydroquinone, 2 g of resorcin aldoxime and 0.1 g of 1-phenyl-5-mercaptotetrazole per g of silver as stabilizers.

Polyacrylamides and other polymers were added to emulsion layers and protective layers in the form substituted on gelatin. In addition, the following compound:

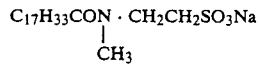

and saponin were added as coating aids, and

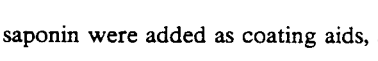

was added as a vinylsulfone type hardener, and further sodium polystyrenesulfonate as a thickener, and a polyethyl acrylate dispersion as a latex polymer were added.

The hydrazine compounds were selected from among the illustrative compounds, and the amounts added were decided to obtain an optimal gradation (see Table 1).

As a protective layer, a gelatin aqueous solution containing gelatin, sodium dodecylbenzenesulfonate, silicone oil, colloidal silica, a dispersion of polyethyl acrylate, a polymethyl methacrylate matting agent (particle size: 2.5 μm) and a sodium polystyrenesulfonate thickener were coated in a gelatin amount of 1.6 g/m$^2$. The emulsion was coated in a silver amount of 3.6 g/m$^2$ by simultaneousl.y coating the protective layer and the emulsion layer.

The pH of the protective layer and of the emulsion layer were adjusted to 6.5 to 7.5 and 6.0 to 7.0, respectively, with a phosphoric acid solution.

Coated samples were prepared in the abovedescribed manner according to the combination shown in Table 1 for evaluation.

Method of Evaluating Scratches:

Nonprocessed coated samples were passed beneath loaded sapphire needles (having a diameter of 0.1 mm and 0.01 mm), developed at a developing temperature of 34° C. for 30 seconds with Developer A using an automatic developing machine ("model FG 660F" made by the Fuji Photo Film Co., Ltd.), then subjected to fixing, washing with water, and drying. Blackened degrees of the portions scratched by the needles were visually evaluated in five even ranks of 5 (good) to 1 (poor).

| Formulation of Developer A: | |
|---|---|
| Hydroquinone | 50 g |
| N-Methyl-p-aminophenol ½ Sulfate | 0.3 g |
| NaOH | 18 g |
| 5-Sulfosalicylic Acid | 55 g |
| Potassium Sulfite | 110 g |
| Disodium Ethylenediaminetetraacetate | 1.0 g |
| KBr | 10 g |
| 5-Methylbenzotriazole | 0.4 g |
| 2-Mercaptobenzimidazole-5-sulfonic Acid | 0.3 g |
| 3-(5-Mercaptotetrazole)benzenesulfonic Acid Sodium Salt | 0.2 g |
| N-n-Butyldiethanolamine | 15 g |
| Sodium Toluenesulfonate | 8 g |
| Water to make | 1 liter |

-continued

| Formulation of Developer A: |
|---|
| pH was adjusted to 11.6 with KOH |

Method of Evaluating Black Pepper:

Coated samples were developed at a developing temperature of 34° C. for 40 seconds using an automatic developing machine containing Developer B (prepared by adding KOH to Developer A to adjust its pH to 11.9), then subjected to fixing, washing with water, and drying.

Frequency of black pepper generation of the thus-processed samples was visually evaluated in five even ranks of 5 (good) to 1 (poor).

TABLE 1

| Sample No. | Hydrazine Compound Emulsion | Hydrazine Compound Kind | Hydrazine Compound Added Amount (mol/mol-Ag) | Polymer Kind | Polymer $\overline{M}w$ | Polymer Added Amount ($g/m^2$) | Evaluation of Properties Scratches | Evaluation of Properties Black Peppers | Note |
|---|---|---|---|---|---|---|---|---|---|
| 1 | (a) | I-5 | $8 \times 10^{-4}$ | — | — | — | 2.0 | 2.0 | Comparison |
| 2 | " | " | " | Polyvinyl alcohol | 50,000 | 1.0 | 2.5 | 2.0 | " |
| 3 | " | " | " | Polyvinyl-pyrrolidone | " | " | 2.0 | 2.5 | " |
| 4 | " | " | " | Compound (II-1) | " | " | 4.0 | 3.5 | Invention |
| 5 | " | " | " | Compound (II-1) | 5,000 | " | 4.5 | 4.0 | " |
| 6 | " | " | " | Compound (II-1) | " | 0.5 | 4.0 | 3.5 | " |
| 7 | " | " | " | Compound (II-1) | " | 0.25 | 3.5 | 3.0 | " |
| 8 | " | " | " | Compound (II-3) | " | 1.0 | 5.0 | 4.5 | " |
| 9 | (b) | I-19 | $8 \times 10^{-5}$ | — | — | — | 3.0 | 2.5 | Comparison |
| 10 | " | " | " | Polyvinyl alcohol | 50,000 | 0.5 | 3.0 | 2.5 | " |
| 11 | " | " | " | Dextran | " | " | 3.0 | 3.0 | " |
| 12 | " | " | " | " | 5,000 | " | 3.5 | 2.5 | " |
| 13 | (b) | I-19 | $8 \times 10^{-5}$ | Compound (II-1) | 5,000 | 0.5 | 4.5 | 4.0 | Invention |
| 14 | " | " | " | Compound (II-11) | " | " | 5.0 | 4.5 | " |

As is apparent from the results of Table 1, the addition of the polyacrylamide derivative distinctly served to reduce scratches and black peppers.

EXAMPLE 2

(A) Preparation of Silver Halide Emulsion

A monodisperse silver chlorobromoiodide emulsion containing grains having a 0.25 μm grain size (variation coefficient: 0.13; silver iodide content: 1.0 mol%; silver bromide content: 90 mol%) was prepared by a controlled double jet process. To this emulsion was added $(NH_4)_3RhCl_6$ and $K_3IrCl_6$ in an amount of $5\times10^{-6}$ mol/mol-Ag and an amount of $5\times10^{7}$ mol/mol-Ag, respectively.

This emulsion was desalted in a conventional manner and, after adding thereto 5,5,-dichloro-9-ethyl-3,3,-bis(3-sulfopropyl)oxacarbocyanine sodium salt in an amount of $3\times10^{-4}$ mol/mol-Ag, subjected to gold and sulfur sensitization usin9 sodium thiosulfate and potassium chloroaurate. This emulsion was referred to as Emulsion (c).

A monodisperse silver bromoiodide emulsion having a 0.3 μm grain size (variation coefficient: 0.15; silver iodide content: 0.5 mol%; iodide distribution: uniform) was prepared in the same manner by a controlled double jet process.

With this silver bromoiodide emulsion, grain formation was conducted in the presence of $8\times10^{-6}$ mol of $(NH_4)_3RhCl_6$ and $8\times10^{-6}$ mol of $K_3IrCl_6$ per mol of silver.

This emulsion was desalted in a conventional manner, and a sensitizing dye was added thereto in an amount as per Emulsion (c) to obtain Emulsion (d).

To these emulsions were added 1.5 g of 4-hydroxy-6-methyl-1,3,3a,7-tetraazaindene, 8 g of methylhydroquinone, 2 g of resorcin aldoxime, and 0.1 g of 1-phenyl-5-mercaptotetrazole per mol of silver.

The polyacrylamide derivatives and other polymers were added to protective layers in the form substituted on gelatin. In addition, the following compound:

$$C_{17}H_{33}\underset{\underset{CH_3}{|}}{CON}.CH_2CH_2SO_3Na$$

and saponin were added as coating aids, and $$CH_2{=}CHSO_2CH_2OCH_2SO_2CH{=}CH_2$$

was added as a vinylsulfone type hardener, and further sodium polystyrene sulfonate as a thickener, and polyethyl acrylate dispersion as a latex polymer were added.

The hydrazine compounds were selected from among the illustrative compounds as per Table 2, and the amounts added were decided to obtain optimal gradation.

As a protective layer, a gelatin aqueous solution containing gelatin, sodium dodecylbenzenesulfonate, silicone oil, colloidal silica, a dispersion of polyethyl acrylate, a polymethyl methacrylate matting agent (particle size: 2.5 μm) and a sodium polystyrenesulfonate thickener was coated in a gelatin amount of 1.6 $g/m^2$. The emulsion was coated in a silver amount of 3.6 $g/m^2$ by simultaneously coating the protective layer and the emulsion layer.

The pH of the protective layer and the emulsion layer were adjusted to 6.5 to 7.5 and 6.0 to 7.0, respectively, with a phosphoric acid solution.

Coated samples prepared by using additives in an amount as shown in Table 2 were evaluated with respect to scratches and black peppers in the same manner as in Example 1.

As is apparent from the results of Table 2, the addition of the polyacrylamide derivatives served to reduce both black peppers and scratches, whereas the addition of comparative compounds was ineffective

TABLE 2

| Sample No. | Hydrazine Compound Emulsion | Kind | Added Amount (mol/mol-Ag) | Polymer Kind | $\overline{M}w$ | Added Amount ($g/m^2$) | Evaluation of Properties Scratches | Black Peppers | Note |
|---|---|---|---|---|---|---|---|---|---|
| 15 | (c) | I-30 | $4 \times 10^{-4}$ | — | — | — | 2.5 | 2.5 | Comparison |
| 16 | " | " | " | Polyacrylic acid | 100,000 | 1.0 | 2.5 | 2.0 | " |
| 17 | " | " | " | Dextran | " | " | 2.5 | 2.5 | " |
| 18 | " | " | " | Pullulan | " | " | 3.0 | 2.5 | " |
| 19 | " | " | " | Compound (II-1) | 10,000 | " | 4.0 | 4.0 | Invention |
| 20 | " | " | " | Compound (II-4) | " | " | 4.5 | 4.5 | " |
| 21 | (d) | I-27 | $1 \times 10^{-4}$ | — | — | — | 3.0 | 3.0 | Comparison |
| 22 | " | " | " | Polyvinyl alcohol | 10,000 | 0.5 | 2.5 | 3.0 | " |
| 23 | " | " | " | Polyvinyl-pyrrolidone | " | " | 3.0 | 3.0 | " |
| 24 | " | " | " | Pullulan | " | " | 3.0 | 3.0 | " |
| 25 | " | " | " | Dextran | " | " | 3.0 | 3.0 | " |
| 26 | " | " | " | Compound (II-11) | " | " | 4.5 | 4.0 | Invention |
| 27 | (d) | I-27 | $1 \times 10^{-4}$ | Compound (II-10) | 10,000 | 0.25 | 3.5 | 3.5 | Invention |
| 28 | " | " | " | Compound (II-10) | " | 0.5 | 4.5 | 4.5 | " |
| 29 | " | " | " | Compound (II-10) | " | 1.0 | 5.0 | 5.0 | " |

EXAMPLE 3

Samples 1 to 14 in Example 1 were processed under the same conditions as in Example 1 except for using the following developer.

In comparison with the comparative samples, the samples of the present invention suffered less scratches and less generation of black peppers.

| | |
|---|---|
| Hydroquinone | 50.0 g |
| N-Methyl-p-aminophenol ½ Sulfate | 0.3 g |
| 4-Methyl-4-hydroxymethyl-1-phenyl-3-pyrazolidone | 0.2 g |
| Sodium Hydroxide | 18.0 g |
| Potassium Secondary Phosphate | 38.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)-benzenesulfonate | 0.2 g |
| N-n-Butyldiethanolamine | 15.0 g |
| Sodium Toluenesulfonate | 8.0 g |
| Water to make | 1 liter |
| pH was adjusted to 11.6 by adding KOH | |

While the invention has been described in detail and with reference to specific embodiments thereof, it will be apparent to one skilled in the art that various changes and modifications can be made therein without departing from the spirit and scope thereof.

What is claimed is:

1. A negative type silver halide photographic material which comprises:

a support having thereon at least one silver halide emulsion layer and at least one other hydrophilic colloidal layer, wherein said at least one said silver halide emulsion layer or said at least one said other hydrophilic colloidal layer contains a hydrazine derivative and a polyacrylamide derivative, wherein said polyacrylamide derivative has a weight average molecular weight of 2,000 to 50,000 and is present in an amount of from 0.1 to 1.5 g per $m^2$ of said photographic material and said hydrazine is present in an amount of from $1 \times 10^{-5}$ to $2 \times 10^{-2}$ mol per mol of silver halide.

2. The negative type silver halide photographic material as claimed in claim 1, wherein said hydrazine derivative is represented by formula (I):

$$R_1\text{-NHNH-G-}R_2 \qquad \text{(I)}$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group or an N-substituted or unsubstituted imino group.

3. The negative type silver halide photographic material as claimed in claim 1, wherein said polyacrylamide derivative is a polymer containing the repeating units represented by formula (II):

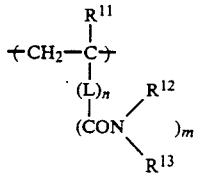

(II)

wherein $R^{11}$ represents a hydrogen atom or an alkyl group containing 1 to 6 carbon atoms, $R^{12}$ and $R^{13}$, which may be the same or different, each represents a hydrogen atom, a substituted or unsubstituted alkyl group containing not more than 10 carbon atoms, an aryl group or an aralkyl group, or $R^{12}$ and $R^{13}$ may be bound to each other to form a nitrogen-containing hetero ring together with a nitrogen atom; L represents a divalent linking group; n represents 0 or 1; and m represents 1 or 2.

4. A method for forming a superhigh contrast negative image which comprises:

imagewise exposing a negative type silver halide photographic material and development processing said photographic material in a developer containing sulfite ion in a concentration of 0.15 mol/liter or more and having a pH of 10.0 to 12.5;

where said negative type silver halide photographic material comprising a support having thereon at least one silver halide emulsion layer and at least one other hydrophilic colloidal layer, wherein said at least one said silver halide emulsion layer or said at least one said other hydrophilic colloidal layer contains a hydrazine derivative present in an amount of from $1\times10^{-5}$ to $2\times10^{-2}$ mol per mol of silver halide and a polyacrylamide derivative having a weight average molecular weight of 2,000 to 50,000 and present in an amount of from 0.1 to 1.5 g per $m^2$ of said photographic material.

* * * * *

UNITED STATES PATENT AND TRADEMARK OFFICE

CERTIFICATE OF CORRECTION

PATENT NO. : 4,996,130

DATED : February 26, 1991

INVENTOR(S) : Shuzo Suga; Masaki Satake; Senzo Sasaoka

It is certified that error appears in the above-identified patent and that said Letters Patent is hereby corrected as shown below:

Title page, item [30] from "63-316972" and insert therefor -- 62-316972 --.

Signed and Sealed this

Twenty-second Day of September, 1992

*Attest:*

DOUGLAS B. COMER

*Attesting Officer*

*Acting Commissioner of Patents and Trademarks*